United States Patent [19]

Jimena

[11] Patent Number: 4,491,260

[45] Date of Patent: Jan. 1, 1985

[54] ELECTRIC STAPLER

[76] Inventor: Carlos L. Jimena, 327 Douglas St., Salt Lake City, Utah 84102

[21] Appl. No.: 399,921

[22] Filed: Jul. 19, 1982

Related U.S. Application Data

[63] Continuation of Ser. No. 153,356, May 27, 1980, abandoned.

[51] Int. Cl.[3] ..... B25C 5/15; B27F 7/36

[52] U.S. Cl. ..... 227/7; 227/131

[58] Field of Search ..... 227/8, 121, 7, 131; 361/192

[56] References Cited

U.S. PATENT DOCUMENTS

| | | | |
|---|---|---|---|
| 3,276,654 | 10/1966 | Yeager et al. | 227/131 |
| 3,278,101 | 10/1966 | Hatazaki | 227/7 |
| 3,282,489 | 11/1966 | March | 227/7 |
| 3,345,546 | 10/1967 | Beltramo | 318/132 |
| 3,346,163 | 10/1967 | Manganaro | 227/131 |
| 3,347,438 | 10/1967 | Doherty | 227/131 |
| 3,347,440 | 10/1967 | Doherty | 227/131 |
| 3,380,640 | 4/1968 | Singerman et al. | 227/131 |
| 3,531,036 | 9/1970 | Felson | 227/131 X |
| 3,662,190 | 5/1972 | Naber | 227/131 X |
| 3,666,157 | 5/1972 | Kawai et al. | 227/131 |
| 3,786,286 | 1/1974 | Palsson et al. | 227/131 X |
| 3,898,547 | 8/1975 | Poole | 361/192 X |
| 3,984,733 | 2/1976 | Holm et al. | 361/192 X |
| 4,245,271 | 1/1981 | Gwin | 361/192 X |

FOREIGN PATENT DOCUMENTS

| | | | |
|---|---|---|---|
| 741731 | 12/1955 | United Kingdom | 227/131 |

*Primary Examiner*—Paul A. Bell

*Attorney, Agent, or Firm*—John P. Dellett

[57] ABSTRACT

An automatic electric stapler in which the driver of the stapler is fixed to the armature of a solenoid so that actuation of the solenoid directly drives the driver of the stapler against the anvil of the stapler. Staples are mounted in a magazine in the device and fed by spring bias towards the driver. The solenoid is controlled by two switches linked to two control relays.

1 Claim, 3 Drawing Figures

ELECTRIC STAPLER

This is a continuation of application Ser. No. 153,356, filed May 27, 1980, now abandoned.

PRIOR ART

Electric staplers of considerably greater complexity for performing a similar function are disclosed in the following U.S. patents:

U.S. Pat. No. 3,276,654
U.S. Pat. No. 3,278,101
U.S. Pat. No. 3,282,489
U.S. Pat. No. 3,347,440
U.S. Pat. No. 3,625,405
U.S. Pat. No. 3,345,546
U.S. Pat. No. 3,346,163
U.S. Pat. No. 3,347,438
U.S. Pat. No. 3,380,640
U.S. Pat. No. 3,666,157

SUMMARY OF THE INVENTION

My invention is an automatic electric stapler in which the driver of the stapler is fixed to the armature of a solenoid so that actuation of the solenoid directly drives the driver of the stapler against the anvil of the stapler. Staples are mounted in a magazine in the device and fed by spring bias towards the driver. The solenoid is controlled by two switches linked to two control relays.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
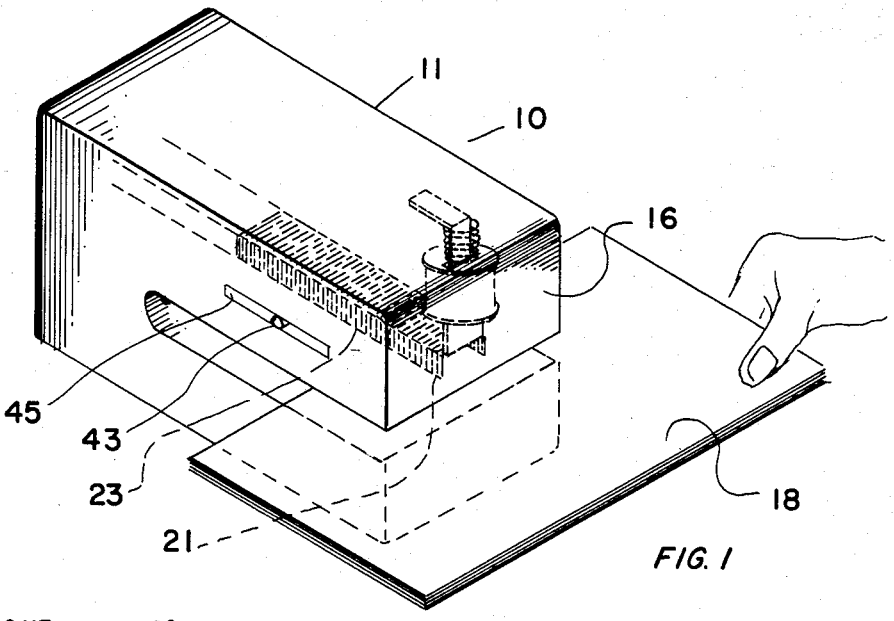
FIG. 1 is a perspective view of the invention in use.
Figure 3:
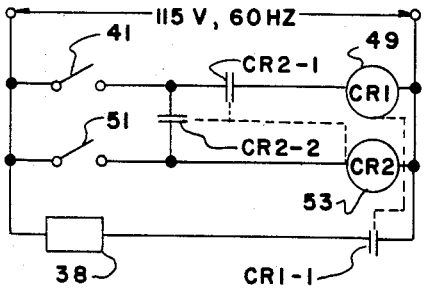
FIG. 3 is a schematic view of the electrical circuit of the invention.
Figure 2:
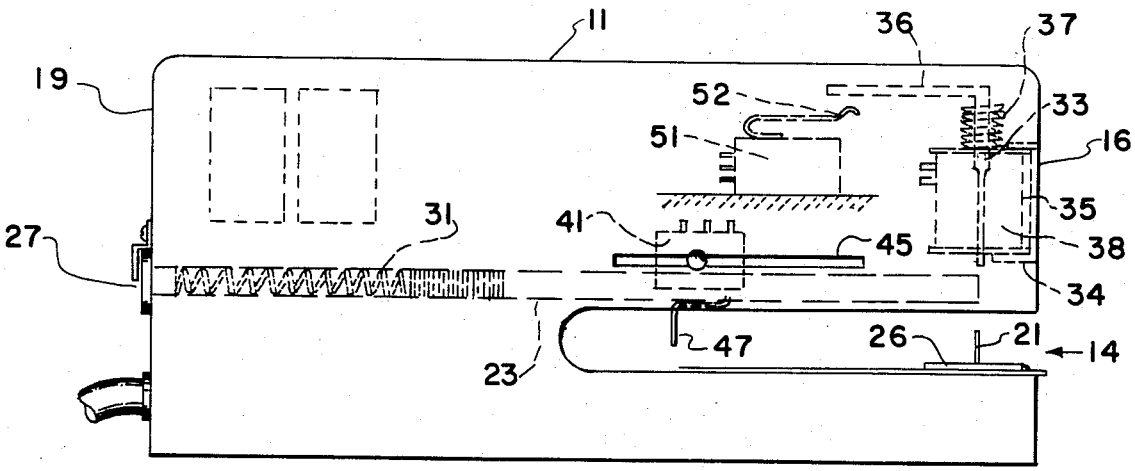
FIG. 2 is a side view of the invention.

Turning now descriptively to the drawings, in which similar reference characters denote similar elements throughout the several views, FIGS. 1–2 illustrate the automatic stapler 10 enclosed in a housing 11 formed with an open horizontal slot 14 extending from a forward end side 16 into which sheets of paper 18 may be inserted so that the sheets may be fastened together by a staple 21 punched from a magazine 23 of staples by the driver 63 which compresses the staple 21 against an anvil 26 fixed to the bottom of the slot section of the housing.

The staple magazine 23 is located in a horizontal slide chamber of the housing which extends to the rear end side 19 of the housing with a removable plug 27 fastened to the opening of the chamber so as to hold a compression spring 31 against the magazine 23.

Driver 63 is directly attached to the armature 33 of solenoid 35 which is internally fixed inside of housing 11 by bracket 34 so that armature 33 moves vertically downwards when solenoid 35 is energized, with a coil compression spring 37 mounted about the section of the armature that extends upward beyond the solenoid coil 38 biasing armature 33 normally upwards.

A trigger switch 41 is adjustably mounted by a bolt 43 in a horizontal slot 45 of housing 11 so that with bolt 43, switch 41 may be advanced parallel to the axis of slot 14 for adjustment of location of the actuator arm 47 of switch 41, with relation to the vertical axis of driver 63 and solenoid armature 33, so as to locate the position of a staple driver into paper sheets 18, the forward edge of which engage switch actuator arm 47 to cause the Normally Off switch contacts to close a circuit from the supply voltage through a Normally Closed relay contact CR2-1 of control relay CR2 and through the coil 49 of control relay CR1 to close Normally Open relay contact CR-1-1 of relay CR1 which are in series between the supply voltage and the coil 38 of solenoid 35, thus energizing solenoid coil 38 when switch 41 is initially triggered to the ON position.

A reset switch 51 is mounted inside housing 11 so as to be actuated when the top end 36 of the solenoid armature contacts the actuator 52 of switch 51 in the down energized position of the solenoid armature. The normally open contacts of switch 51 are in series between the supply voltage and the coil 53 of control relay CR2. A normally open pair of contacts CR2-2 of control relay CR2 connect the coil 53 of relay CR2 through switch 41 to the supply voltage to form a hold circuit to maintain relay CR-2 in the energized position with switch 41 remaining ON and switch 51 turned OFF by the upward return stroke of solenoid armature after opening of normally closed contacts CR2-1 of control relay CR-2 which opens the circuit of relay coil 49 and thus opens the circuit of solenoid coil 38.

Relay CR-2 thus prevents repeated action of solenoid armature 33 after one staple has been driven through the paper sheets, and prevents any further actuation of coil CR-1 and solenoid coil until after the paper sheets have been removed from engagement with the arm 47 of trigger switch 41.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. In a machine for fastening a staple into one or more sheets of paper:

a solenoid having an operating coil and an armature, the armature being movable in a vertical plane;

a staple driver directly fastened to the armature of said solenoid;

spring means to bias the armature away from an anvil;

a source of operating voltage;

a first control relay having an operating coil coupled to said source of operating voltage, and a set of normally open contacts coupling the operating coil of said solenoid to said source of operating voltage;

a second control relay having an operating coil coupled to said source of operating voltage, a first set of normally closed contacts in series with the operating coil of said first control relay, and a second set of normally open contacts in series with the operating coil of said second control relay;

a paper actuated switch in series with the operating coil of said first control relay, the paper actuated switch when actuated by paper to be stapled closing a circuit through the normally closed contacts of said second control relay connecting the operating coil of said first control relay to said source of operating voltage, said first control relay being thereby energized to close the set of contacts of said first control relay, the closed set of contacts of said first control relay connecting the operating coil of said solenoid to said source of operating voltage to energize said solenoid and actuate said staple driver; and a second normally open switch closed by the actuated armature of said solenoid, said second switch when closed connecting the operating coil of said second control relay to said source of operating voltage to energize said second control relay, the first set of normally closed contacts of said second control relay being thereby opened to deenergize said first control relay, the set of contacts of said first control relay being opened by said deenergized first control relay, the operating coil of said solenoid being thereby deenergized, the second set of contacts of said second control relay closing a holding circuit of the operating coil of said second control relay through said paper actuated switch to said source of operating voltage, said second switch being opened by the armature deactuated in response to the operating coil of said solenoid being deenergized, said second control relay being energized inhibiting said solenoid from being actuated more than one time when the paper is inserted in said machine, said second control relay being deenergized when the paper is removed from said paper actuated switch.

* * * * *

UNITED STATES PATENT AND TRADEMARK OFFICE

CERTIFICATE OF CORRECTION

PATENT NO. : 4,491,260

DATED : January 1, 1985

INVENTOR(S) : Carlos L. Jimena

It is certified that error appears in the above-identified patent and that said Letters Patent is hereby corrected as shown below:

Column 2, line 5, "driver" should be --driven--.

Signed and Sealed this

*Seventh* Day of *May 1985*

[SEAL]

*Attest:*

DONALD J. QUIGG

*Attesting Officer* *Acting Commissioner of Patents and Trademarks*